US005405003A

United States Patent [19]

Schmidt et al.

[11] Patent Number: 5,405,003

[45] Date of Patent: Apr. 11, 1995

[54] COMBINATION DISPLAY AND PACKAGING FOR A TOILET SEAT ASSEMBLY

[75] Inventors: Dale E. Schmidt, Sheboygan; Timothy J. Otte, Sheboygan Falls, both of Wis.

[73] Assignee: Bemis Manufacturing Company, Sheboygan Falls, Wis.

[21] Appl. No.: 60,014

[22] Filed: May 10, 1993

[51] Int. Cl.[6] ..... B65D 85/46

[52] U.S. Cl. ..... 206/321; 206/303; 206/477

[58] Field of Search ..... 206/45.33, 45.14, 231, 206/490, 321, 477, 806, 497, 303; 4/234, 237

[56] References Cited

U.S. PATENT DOCUMENTS

| | | | |
|---|---|---|---|
| 1,598,857 | 9/1926 | Fox et al. . | |
| 1,806,149 | 5/1931 | Daugherty | 206/806 X |
| 2,057,781 | 10/1936 | Kulp | 206/16 |
| 2,305,332 | 12/1942 | Ullman | 206/44 |
| 2,595,043 | 4/1957 | Zimmerman | 206/45.33 X |
| 3,104,011 | 9/1963 | Bowman | 206/45.33 |
| 3,757,937 | 9/1973 | Weinstein | 206/45.33 X |
| 3,814,303 | 6/1974 | Smith | 206/806 X |
| 4,166,533 | 9/1979 | Maitland | 206/45.14 X |
| 4,590,610 | 5/1986 | Rhyne | 206/45.33 X |
| 4,650,074 | 3/1987 | Vosbikiam | 206/45.14 X |
| 5,090,063 | 2/1992 | Edwards et al. | 206/225 X |

OTHER PUBLICATIONS

Sears Toilet Seat Packaging illustrated on the attached four sheets.

*Primary Examiner*—Paul T. Sewell
*Assistant Examiner*—BethAnne C. Cicconi
*Attorney, Agent, or Firm*—Michael, Best & Friedrich

[57] ABSTRACT

A combination display and packaging for a toilet seat assembly including, when the assembly is in a closed position on a toilet, a toilet seat having a downwardly facing surface, a toilet seat cover substantially overlying the seat and having an upwardly facing surface, and a hinge pivotably connecting the cover and the seat, the display and packaging comprising a back wall, a loop on the back wall for supporting the back wall in a vertically extending position on a projection, the toilet seat assembly being supported on the back wall such that the downwardly facing surface of the toilet seat faces the back wall and such that the hinge and the entire upwardly facing surface of the cover are visible.

20 Claims, 2 Drawing Sheets

COMBINATION DISPLAY AND PACKAGING FOR A TOILET SEAT ASSEMBLY

BACKGROUND OF THE INVENTION

1. Technical Field

The invention relates generally to packaging for storing and displaying an article, and more particularly to packaging for a toilet seat assembly.

2. Related Prior Art

It is generally known to package a toilet seat assembly for storage, transportation and display using a sheet of corrugated paper or cardboard to serve as a backing for a toilet seat assembly, and to wrap the backing and toilet seat assembly in plastic. It is also known to provide such packaging with a plastic handle connected to the cardboard sheet to facilitate the hanging of the toilet seat assembly on a projection such as a display peg and to facilitate the carrying of the packaging.

SUMMARY OF THE INVENTION

The invention provides a combination display and packaging for a toilet seat assembly including, when the assembly is in a closed position on a toilet, a toilet seat having a downwardly facing surface, a toilet seat cover substantially overlying the seat and having an upwardly facing surface, and a hinge pivotably connecting the cover and the seat, the combination display and packaging comprising a back wall, means on the back wall for supporting the back wall in a vertically extending position on a projection, means for supporting the toilet seat assembly on the back wall such that the downwardly facing surface of the toilet seat faces the back wall and for allowing viewing of the hinge and of the entire upwardly facing surface of the cover, the toilet seat assembly supporting means including a support extending forwardly from the back wall and below the seat and means for securing the toilet seat against the back wall.

The invention also provides a combination display and packaging for a toilet seat assembly including a toilet seat, a toilet seat cover, and a hinge connecting the cover and the seat, the display and packaging comprising a back wall having an upper edge, means for securing the toilet seat assembly to the back wall, and hanger means on the back wall for supporting the back wall on a projection, the hanger means including a loop hingedly connected to the back wall, the loop defining an aperture and being movable between a storage position wherein the loop is substantially flush with the back wall and a hanging position wherein the aperture extends above the upper edge of the back wall.

The invention also provides a combination display and packaging for a toilet seat assembly including, when the assembly is in a closed position on a toilet, a toilet seat having a downwardly facing surface, a toilet seat cover substantially overlying the seat and having an upwardly facing surface, and a hinge pivotably connecting the cover and the seat, the display and packaging comprising a back wall, hanger means hingedly connected to the back wall for supporting the back wall in a vertically extending position on a projection, the hanger means including a generally annular loop integrally formed with the back wall and defining an aperture, the loop being movable between a storage position wherein the loop is substantially flush with the back wall and a hanging position wherein the aperture extends above the upper edge of the back wall, and means for supporting the toilet seat assembly on the back wall such that the downwardly facing surface of the toilet seat faces the back wall and for allowing viewing of the hinge and of the entire upwardly facing surface of the cover, the supporting means including a support shelf extending forwardly from the back wall below the toilet seat and means for securing the toilet seat against the back wall.

The invention also provides a method for packaging a toilet seat for storage and display, the method comprising the steps of: providing a toilet seat assembly including a toilet seat and a toilet seat cover hingedly connected to the seat, providing a packaging blank having an integrally formed loop defining an aperture and being hingedly connected to the blank, placing the assembly on the blank, folding an edge of the blank into a supporting position adjacent the seat, shrink wrapping the toilet seat assembly and the blank with a plastic film, and removing a portion of the plastic film overlying the loop.

One of the features of the combination display and packaging is the provision of a foldable blank for supporting a toilet seat assembly and for being supported on a display peg without requiring additional separate hangers or handles.

Another feature of the combination display and packaging is the provision of a toilet seat assembly package that can be used to display the assembly by suspending it from a display peg. The display allows a purchaser to view the entire front of the toilet seat cover and hinges. The packaging also permits a purchaser to inspect the contents of the package for completeness.

Another feature of the invention is the provision of a simplified method of packaging a toilet seat assembly.

Other features and advantages of the invention will become apparent to those skilled in the art upon review of the following detailed descriptions, claims and drawings.

Figure 1:
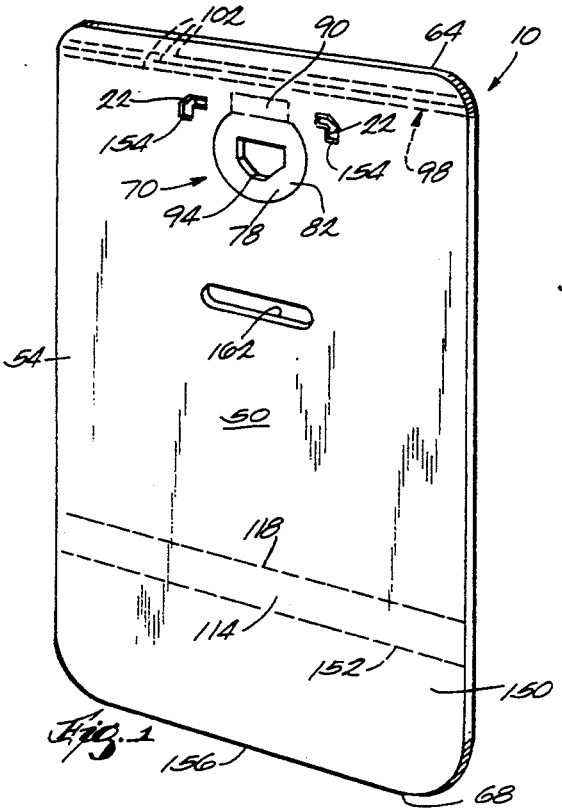
FIG. 1 is a perspective view of a combination display and packaging that is a first alternative embodiment of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
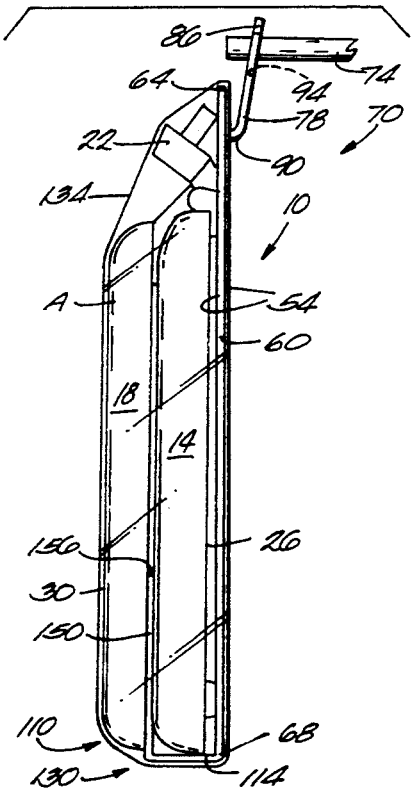
FIG. 2 is a side elevation view of the blank shown in FIG. 1 showing the blank in a folded position supporting a first toilet seat assembly.

The drawings illustrate a combination display and packaging 10 for a toilet seat assembly. The drawings illustrate two toilet seat assemblies A, B that differ only in details of construction. FIG. 2 illustrates a first toilet seat assembly construction A, and FIGS. 3–7 illustrate a second toilet seat assembly construction B. Unless otherwise specified, assemblies A and B are interchangeable and, for the purposes of simplifying the disclosure of the combination display and packaging 10, references to the toilet seat assembly construction A can be considered to apply equally to toilet seat assembly construction B.

The toilet seat assemblies A and B each include a toilet seat 14, a toilet seat cover 18, and a pair of hinges 22 pivotally connecting the seat 14 and cover 18 (only one hinge 22 associated with toilet seat assembly A is shown in FIG. 2). When the toilet seat assemblies A and B are positioned on respective toilets (not shown) and are closed so that the covers 18 overlie the seats 14, each seat 14 has a downwardly facing surface 26 (shown extending vertically and facing to the right in FIGS. 2 and 4) and each cover 18 has an upwardly facing surface 30 (shown extending vertically and facing to the left in FIGS. 2 and 4).

In the toilet seat assembly construction B shown in FIGS. 37, the toilet seat 14 and cover 18 are spaced apart by the hinges 22. In addition, the toilet seat 14 includes (FIGS. 4 and 6) a pair of pegs 34 (only one shown) extending from the cover 18 into contact with the seat 14 for maintaining therebetween a uniform spacing. The toilet seat 14 in the construction A is only slightly spaced by the hinges 22 from the associated cover 18. The cover 18 does not, however, include any pegs or other projections which contact the seat 14.

The packaging 10 includes a foldable sheet or blank 50 made of corrugated paper. The blank 50 has (FIGS. 2, 4 and 6) generally planar opposite faces 54 and is generally rectangular. The blank 50 can be folded from an unfolded position shown in FIGS. 1 and 5 into a supporting position shown in FIGS. 2–4, 6 and 7. When so folded, the upper portion of the blank 50 provides (FIGS. 2, 4 and 6) a back wall 60 having upper and lower edges 64, 68.

Figure 6:
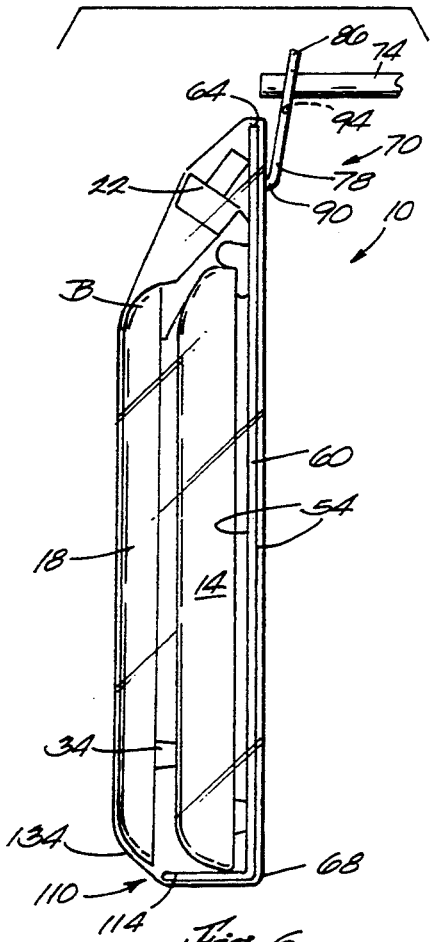
FIG. 6 is a side elevation view of the blank shown in FIG. 5 showing the blank in a folded position supporting a toilet seat assembly.
Figure 7:
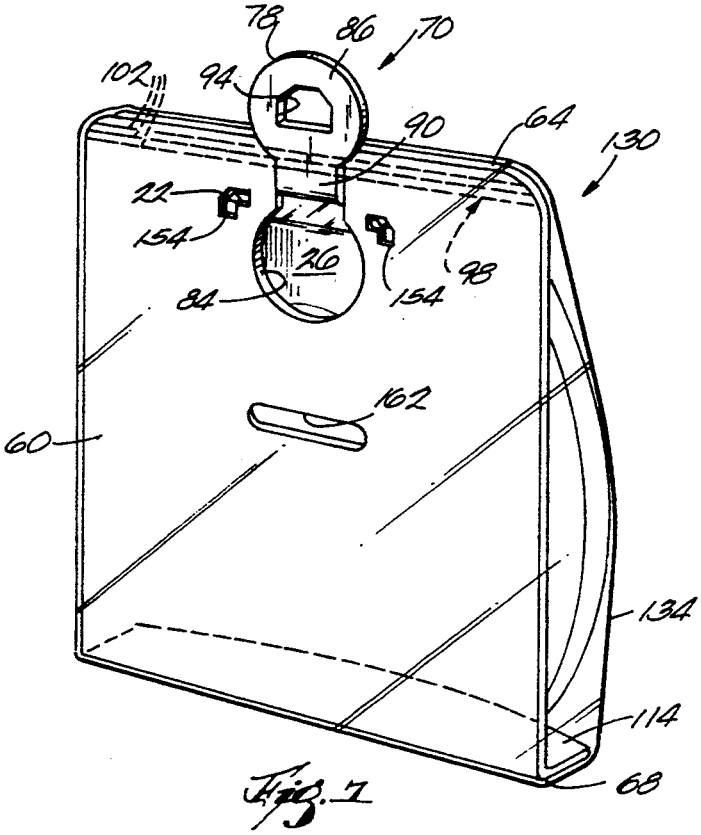
FIG. 7 is a rear view of the combination packaging and display shown in FIG. 5.

The packaging 10 also includes (FIGS. 2 and 6) hanger means 70 hingedly connected to the back wall 60 for supporting the back wall 60 on a projection such as a display hook or peg 74. While various suitable constructions for the hanger means 70 can be successfully used, in the illustrated embodiments, the hanger means 70 includes a loop 78 that is integrally formed with, and hingedly connected to, the back wall 60. As best shown in FIG. 7, the loop 78 is formed by perforating the back wall 60 to define a cut-out portion 82 which defines the loop 78 and is adjacent the upper edge 64. The loop 78 is a generally annular portion 86 of the sheet 50 and, with the exception of an elongated hinge portion 90 that remains integrally connected to the back wall 60, is separable from the back wall 60. For reasons discussed below, the cut-out portion 82 of the back wall 60 is located so that, when the loop 78 is separated from the back wall 60, the resultant opening 84 in the back wall 60 exposes a portion of the downwardly facing surface 26 of the toilet seat 14. The loop 78 defines an aperture 94 formed by removing material from the cut-out portion 82 of the back wall 60. The portion 86 of the sheet 50 is sufficiently wide so that the loop 78 is strong enough to remain intact when supporting the back wall 60 and the toilet seat assembly A and when the loop 78 is suspended from the display peg 74.

As shown in FIGS. 1, 3, 5 and 7, the hinge 90 extends generally parallel to the upper edge 64 of the back wall 60 and is flexible so as to provide a hinged connection between the loop 78 and the back wall 60. By virtue of the hinged connection between the loop 78 and the back wall 60, the loop 78 is movable about an axis defined by the hinge 90 between a closed or storage position (FIGS. 1 and 3–5) wherein the loop 78 is substantially flush with the back wall 60, and a hanging position (FIGS. 2, 6 and 7) wherein the loop 78 extends upwardly and generally rearwardly from the back wall 60. When the loop 78 is in the hanging position, the aperture 94 extends above the upper edge of the back wall 60 and, as shown in FIGS. 2 and 6, the loop 78 can be placed on and suspended by the display peg 74 so that the back wall 50 hangs generally vertically. Because the aperture 94 extends above the upper edge 64 of the back wall 60 when the loop 78 is in the hanging position, the display peg 74 can freely extend through the aperture 94 past the back wall 60 and can therefore support multiple toilet seat assemblies A for display.

The hinge 90 extends along a sufficient width of the back wall 60 so as to be strong enough to remain intact when the back wall 60 and the toilet seat assembly A are suspended by the loop 78 from the display peg 74. In order to further strengthen the upper portion of the blank 50, so that the upper portion of the blank 50 between the hinge 90 and the upper edge 64 does not tear when the loop 78 supports the toilet seat assembly A and the blank 50, the packaging 10 also includes (see FIGS. 1, 3, 5 and 7) means 98 for reinforcing the upper portion of the blank 50. While various suitable constructions for the reinforcing means 98 can be used, in the illustrated embodiment, the reinforcing means 98 includes a plurality of reinforcing fibers 102 extending laterally across the upper portion of the blank 50 intermediate the hinge 90 and the upper edge 64 of the back wall 60. Preferably, the fibers 102 have a relatively high tensile strength and are embedded in the corrugated paper. A suitable fiber for use to reinforce the upper portion of the back wall 60 is sold by the H. B. Fuller Company under the trademark STRING-KING®. The fibers 102 prevent tearing of the upper portion of the back wall 60 when the combination packaging and display 10 is suspended by the loop 78 from the display peg 74 and supports the toilet seat assembly A in the manner discussed below.

The packaging 10 also includes means 110 for supporting the toilet seat assembly A on the back wall 60 such that the downwardly facing surface 26 of the toilet seat 14 faces the back wall 60 and for allowing viewing of the hinges 22 and the entire upwardly facing surface 30 of the cover 18. While various suitable constructions for the toilet seat assembly supporting means 110 could be successfully used, in each of the embodiments shown in FIGS. 1–7, the means 110 includes a support portion or shelf 114 extending forwardly from the lower edge 68 of the back wall 60 below the toilet seat 14 to support the toilet seat assembly A. The shelf 114 is formed by folding the blank 50 (FIGS. 1 and 5) along a fold line 118 extending generally horizontally across the lower portion of the blank 50.

The toilet seat assembly support means 110 also includes means 130 for securing the toilet seat 14 against the back wall 60. While various suitable constructions could be used for such toilet seat securing means 130, in the illustrated embodiments, such securing means 130 includes a plastic film 134 surrounding the entire back wall 60, the support shelf 114, and the toilet seat assembly A. The plastic film 134 tightly holds the toilet seat assembly A against the back wall 60. Preferably, the plastic film 134 is shrink-wrapped to envelop the entire toilet seat assembly A and the blank 50 as well as any hardware, instructions and the like that may be enclosed with the toilet seat assembly A. Accordingly, the toilet seat assembly supporting means also includes means for securing the toilet seat cover 18 against the toilet seat 14.

In order to permit the loop 78 to be moved from the storage position toward the hanging position, a portion of the plastic film 134 overlying the cut-out portion 82 of the back wall 60 is removed. The plastic film 134 thus surrounds the entire blank 50 and the toilet seat assembly A with the exception of the opening in the back wall 60 left by the loop 78 when it is moved into its hanging position. However, as mentioned above and as best shown in FIG. 7, the cut-out portion 82 and, therefore, the opening 84 in the back wall 60 left by moving the loop 78 from the storage position, are located adjacent the toilet seat 14. The opening 84 is substantially closed by the downwardly facing surface 26 of the toilet seat 14 such that any contents of the packaging 10, such as hardware, instruction sheets and the like, cannot fall through the opening.

Figure 3:
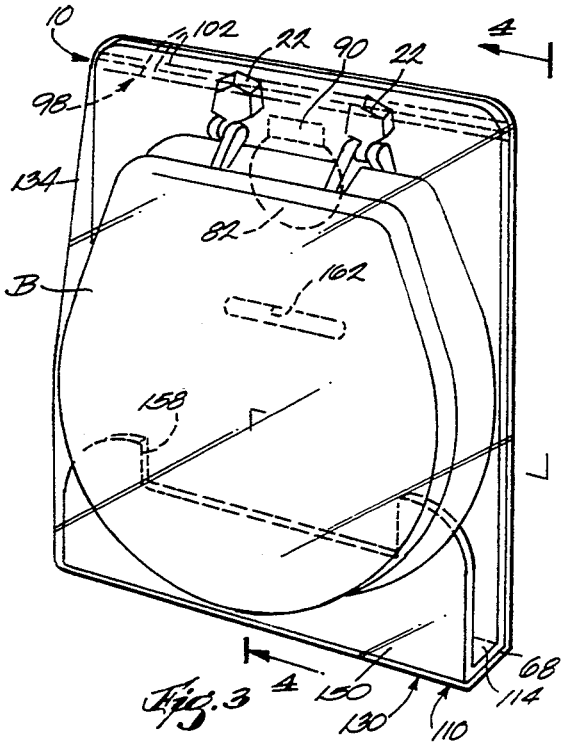
FIG. 3 is a perspective view of a second alternative embodiment of the invention supporting a second toilet seat assembly.
Figure 4:
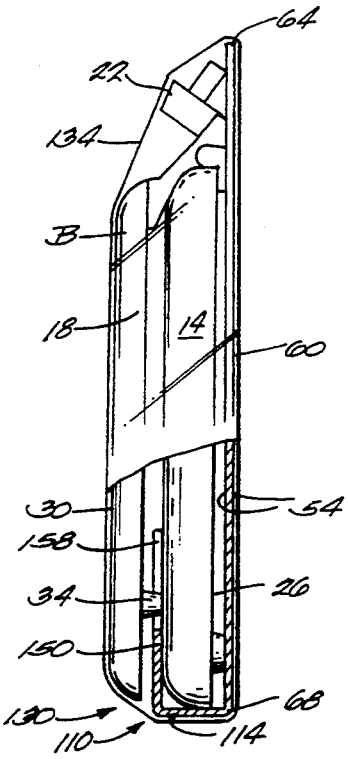
FIG. 4 is a cross-sectional view taken along line 4—4 in FIG. 3.
Figure 5:
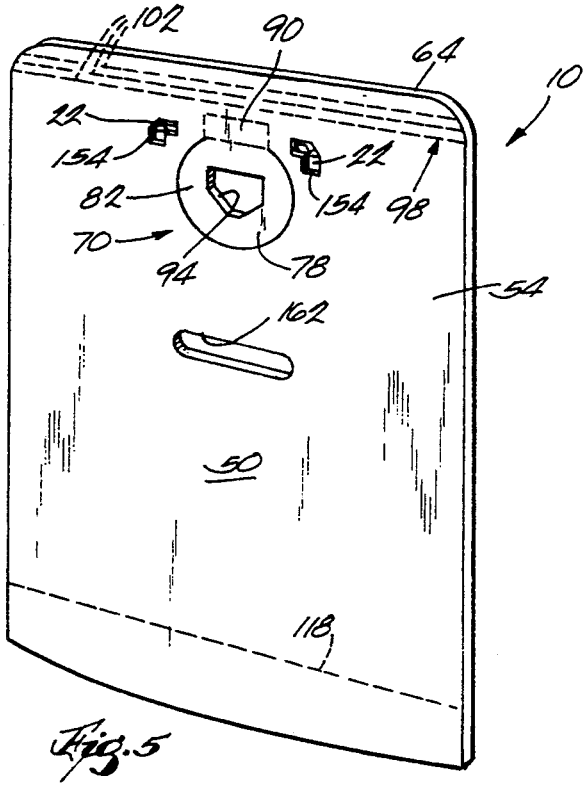
FIG. 5 is a view similar to FIG. 1 illustrating a third alternative embodiment of the invention.

In the embodiments of the packaging 10 shown in FIGS. 1–4, the means 130 for securing the toilet seat 14 against the back wall 60 further includes a capturing portion 150 of the blank 50 that extends generally vertically upwardly from the forward edge of the support shelf 114 into the space between the cover 18 and seat 14. The capturing portion 150 is formed by folding the blank 50 along a fold line 152 parallel to the fold line 118 between the fold line 118 and the bottom edge of the blank 50. As shown in FIGS. 2 and 4, the toilet seat 14 is received by the U-shaped space defined by the back wall 60, the supporting shelf 114, and the capturing portion 150, and the toilet seat 14 is secured in part by the capturing portion 150 against the back wall 60.

The support means 110 also includes (FIGS. 1, 5 and 7) a pair of holes or notches 154 located in the upper portion of the back wall 60 to receive portions of the hinges 22 to allow the rearwardly facing surface 26 of the seat 14 to be closely spaced from the back wall 60.

The first alternative embodiment of the packaging 10, shown in FIGS. 1 and 2, is particularly well-suited to support the toilet seat assembly construction A. As best shown in FIG. 1, the capturing portion 150 has a relatively continuous edge 156 (i.e., the bottom edge 68 of the blank 50) extending between the opposite sides of the blank 50. As shown in FIG. 2, the capturing portion 150 maintains the uniform, slightly spaced relation between the toilet seat 14 and the cover 18.

The second alternative embodiment of the packaging 10, shown in FIGS. 3 and 4, is likewise well-suited to support the toilet seat assembly construction B. In particular, the second alternative embodiment of the packaging 10 provides a capturing portion 150 that includes a recess 158 receiving the spacing pegs 34, thereby allowing the pegs 34 to directly contact the seat 14. Like the capturing portion 150 provided by the first alternative embodiment of the packaging 10 shown in FIGS. 1 and 2, the capturing portion 150 included in the second alternative embodiment of the packaging 10 also maintains the uniform spacing of the seat 14 from the cover 18 from between the hinges 22 and the capturing portion 150.

The packaging 10 also includes a viewing slot 162 located centrally in the back wall 60. The viewing slot 162 permits a purchaser to inspect the contents of the packaging 10, e.g. hardware, instructions and the like, to determine whether the packaging 10 is complete. However, any such contents are retained within the packaging 10 by the shrink-wrapped plastic film 134 that overlies the slot 162. In this regard, as mentioned above, the cut-out portion 82 in the back wall 60 is not covered by the plastic film 134. However, any hardware and the like in the packaging 10 cannot fall through the opening 84 because it is covered by the exposed portion of the downwardly facing surface 26 of the toilet seat 14.

The toilet seat assembly A is packaged for storage and display by the following method. First, the toilet seat assembly A is placed on the blank 50 with the downwardly facing surface 26 of the toilet seat 14 facing the blank 50. Any hardware, instruction sheets or other articles to be packaged with the toilet seat assembly A are affixed to the toilet seat cover 18 or are placed within the space defined by the annular toilet seat 14 and enclosed by the toilet seat cover 18 and the blank 50. The blank 50 is then folded along the fold lines 118 and 152 to provide the back wall 60, the a supporting shelf 114, and the capturing portion 150, with the shelf 114 extending over the end of the toilet seat 14, and with the capturing portion 150 extending between the toilet seat 14 and the cover 18. The entire toilet seat assembly A and the blank 50 are then wrapped with a plastic film 134, such as by shrink wrapping, to secure the toilet seat assembly A to the blank 50. A portion of the plastic wrapping overlying cut-out portion 82 is then removed. The loop 78 is then pivoted from the storage position into the hanging position.

Various other features of the invention are set forth in the following claims.

We claim:

1. Apparatus comprising a toilet seat assembly including, when the assembly is in a closed position on a toilet, a toilet seat having a downwardly facing surface, a toilet seat cover substantially overlying the seat and having an upwardly facing surface, and a hinge pivotably connecting the cover and the seat, and a combination display and packaging including a back wall, a hanger on said back wall for supporting said back wall in a vertically extending position on a projection, a support extending forwardly from said back wall and below the seat for supporting the toilet seat assembly on said back wall such that the downwardly facing surface of the toilet seat faces said back wall and for allowing viewing of the hinge and of the entire upwardly facing surface of the cover, and said toilet seat being secured against said back wall.

2. Apparatus as set forth in claim 1 wherein said toilet seat is secured against said back wall by securing the cover against the toilet seat.

3. Apparatus as set forth in claim 2 wherein said toilet seat is secured against said back wall by a structure surrounding the entire toilet seat assembly.

4. Apparatus as set forth in claim 3 wherein said toilet seat is secured to said back wall by a plastic film.

5. Apparatus as set forth in claim 1 wherein said back wall, said hanger, and said support are provided by a foldable blank.

6. Apparatus as set forth in claim 1 wherein said hanger is hingedly connected to said back wall for receiving the projection.

7. Apparatus as set forth in claim 6 wherein said hanger is a loop integrally formed with said back wall.

8. Apparatus as set forth in claim 7 wherein said loop is defined by a cut-out portion in said back wall.

9. Apparatus as set forth in claim 1 wherein said support includes a capturing portion which extends between the cover and the toilet seat.

10. Apparatus as set forth in claim 9 wherein the cover and toilet seat are arranged in spaced relation and wherein said capturing portion maintains said spaced relation.

11. Apparatus as set forth in claim 1 and further comprising reinforcing fibers for reinforcing the portion of said back wall between said hanger and the edge of said back wall.

12. Apparatus comprising a toilet seat assembly including, when the assembly is in a closed position on a toilet, a toilet seat having a downwardly facing surface, a toilet seat cover substantially overlying the seat and having an upwardly facing surface, and a hinge pivotably connecting the cover and the seat, and a combination display and packaging including a back wall having an upper edge, a hanger hingedly connected to said back wall for supporting said back wall in a vertically extending position on a projection, said hanger being a generally annular loop integrally formed with said back wall and defining an aperture, said loop being movable between a storage position wherein said loop is substantially flush with said back wall and a hanging position wherein said aperture extends above said upper edge of said back wall, a support shelf extending forwardly from said back wall below the toilet seat for supporting the toilet seat assembly on said back wall such that the downwardly facing surface of the toilet seat faces said back wall and for allowing viewing of the hinge and of the entire upwardly facing surface of the cover, and said toilet seat being secured against said back wall.

13. Apparatus as set forth in claim 12 wherein said back wall, said loop and said support shelf are provided by a foldable blank.

14. Apparatus as set forth in claim 13 wherein said loop is hingedly connected to said back wall.

15. Apparatus comprising a toilet seat assembly including, when the assembly is in a closed position on a toilet, a toilet seat having a downwardly facing surface, a toilet seat cover substantially overlying the seat and having an upwardly facing surface, and a hinge pivotably connecting the cover and the seat, and said apparatus also comprising a combination display and packaging including a back wall, hanger means on said back wall for supporting said back wall in a vertically extending position on a projection, means for supporting the toilet seat assembly on said back wall such that the downwardly facing surface of the toilet seat faces said back wall and for allowing viewing of the hinge and of the entire upwardly facing surface of the cover, said toilet seat assembly supporting means including a support extending forwardly from said back wall and below the seat, and means for securing said toilet seat against said back wall.

16. Apparatus as set forth in claim 15 wherein said means for securing said toilet seat against said back wall includes means for securing the cover against said toilet seat.

17. Apparatus as set forth in claim 15 wherein said back wall, said means for supporting said back wall, and said means for supporting the toilet seat assembly on said back wall are provided by a foldable blank.

18. Apparatus as set forth in claim 15 wherein said means for supporting said back wall includes hanger means hingedly connected to said back wall for receiving the projection.

19. Apparatus as set forth in claim 18 wherein said hanger means includes a loop integrally formed with said back wall.

20. Apparatus as set forth in claim 15 wherein said means for securing the toilet seat against the back wall includes a capturing portion extending from said support and extending between said cover and said toilet seat.

* * * * *

UNITED STATES PATENT AND TRADEMARK OFFICE

CERTIFICATE OF CORRECTION

PATENT NO. : 5,405,003

DATED : April 11, 1995

INVENTOR(S) : Dale E. Schmidt, Timothy J. Otte

It is certified that error appears in the above—identified patent and that said Letters Patent is hereby corrected as shown below:

Column 3, line 31, after "FIGS." delete "37" and insert -- 3-7 --.

Signed and Sealed this

Thirteenth Day of June, 1995

Bruce Lehman

*Attest:*

BRUCE LEHMAN

*Attesting Officer*

*Commissioner of Patents and Trademarks*